US005312540A

United States Patent [19]

Kurono et al.

[11] Patent Number: 5,312,540

[45] Date of Patent: May 17, 1994

[54] METHOD OF AND APPARATUS FOR PRODUCING A GRINDER USED FOR A GRINDING MACHINE AND GRINDING-PARTICLES PACKING APPARATUS

[75] Inventors: Hidehiro Kurono; Koji Hatanaka; Yuichi Tazaki, all of Sayama, Japan

[73] Assignee: Honda Giken Kogyo Kabushiki Kaisha, Tokyo, Japan

[21] Appl. No.: 10,880

[22] Filed: Jan. 29, 1993

[30] Foreign Application Priority Data

Jan. 31, 1992 [JP] Japan ..... 4-17096
Mar. 3, 1992 [JP] Japan ..... 4-45806

[51] Int. Cl.[5] ..... C25D 5/02; C25D 15/00

[52] U.S. Cl. ..... 205/110; 51/293; 51/295; 204/193

[58] Field of Search ..... 51/293, 295; 204/193, 204/194; 205/109, 110

[56] References Cited

U.S. PATENT DOCUMENTS 3,980,549 9/1976 Grutza ..... 204/16
4,381,227 4/1983 Narcus ..... 205/110
4,528,074 7/1985 Miyashita et al. ..... 205/110
4,608,128 8/1986 Farmer et al. ..... 205/110
4,659,436 4/1987 Kaylor ..... 205/110
4,817,341 4/1989 Umeda ..... 205/110
4,863,573 9/1989 Moore et al. ..... 205/110

FOREIGN PATENT DOCUMENTS 63-34071 2/1988 Japan .
2113584 10/1983 United Kingdom .

*Primary Examiner*—Mark L. Bell
*Assistant Examiner*—Willie J. Thompson

[57] ABSTRACT

Super-hard grinding particles are electrodeposited on a metallic grinder matrix having recessed portions defined in an outer peripheral surface thereof to thereby produce a desired grinder used for a grinding machine. The grinder matrix is disposed within a mesh-like grinding-particle holder provided in a plating tank. Further, the grinding particles are packed into the grinding-particles holder. The grinding particles held in contact with the recessed portions of the grinder matrix are bonded to the grinder matrix using a plating layer formed by electroplating. The grinder matrix is reversed upsidedown and holding the grinding particles in contact with the recessed portions of the reversed grinder matrix. The grinding particles are bonded again to the grinder matrix using a plating layer formed by electroplating.

3 Claims, 11 Drawing Sheets

METHOD OF AND APPARATUS FOR PRODUCING A GRINDER USED FOR A GRINDING MACHINE AND GRINDING-PARTICLES PACKING APPARATUS

BACKGROUND OF THE INVENTION

1. Field of the Invention

The present invention relates to a method and an apparatus for producing a grinder used for a grinding machine and to a grinding-particles packing apparatus, and more specifically to a method and an apparatus for fabricating a grinder used for a grinding machine, which is used for grinding a gear or the like and has recessed portions defined in the surface thereof and to a grinding-particles packing apparatus.

2. Description of the Related Art

There has heretofore been known an electroplating method as a method of bonding grinding particles to a grinder matrix. There has been proposed, for example, a method of fabricating a grinder matrix and a mold having the shape corresponding to the grinder matrix, packing grinding particles into a space between the grinder matrix and the mold, and introducing a plating solution into the space so as to bond the grinding particles to the grinder matrix.

When, however, the grinder matrix has recessed portions defined in the surface thereof, there is a risk that the grinding particles cannot be reliably packed onto the recessed portions and the bonding of the grinding particles onto the surface of the grinder matrix become ill-balanced. Further, when the grinder matrix includes upwardly-facing surfaces and downwardly-facing surfaces, there is developed, during a plating process, inconvenience that the grinding particles electrodeposited on the downwardly-facing surfaces are relatively reduced in number and the grinding particles electrodeposited on the upwardly-facing surfaces increases in number. In order to solve such inconvenience, there has been proposed a method of coating grinding particles with a metal and magnetizing the coated grinding particles, and bonding the grinding particles to the grinder matrix in a stirred plating tank, thereby making it possible to uniformly electrodeposite the grinding particles even on recessed portions. However, a process for coating the grinding particles with the metal is troublesome and the metal film tends to cause grinding burning upon using the grinder. Further, the metal film increases costs.

SUMMARY OF THE INVENTION

With the foregoing problems in view, it is the object of the present invention to provide a method and an apparatus for producing a grinder used for a grinding machine, which are capable of easily and uniformly electrodepositing grinding particles even on a grinder matrix of any shape and to provide a grinding-particles packing apparatus.

According to one aspect of the present invention, to achieve the above object, there is provided a method of electrodepositing super-hard grinding particles on a metallic grinder matrix having recessed portions defined in an outer peripheral surface thereof, to thereby produce a grinder used for a grinding machine, comprising steps of: disposing the grinder matrix in a mesh-like holder for holding the grinding particles provided within a plating tank; charging the grinding particles into the holder and holding the grinding particles in contact with the recessed portions of the grinder matrix; bonding the grinding particles to the grinder matrix using a plating layer formed by electroplating; reversing the grinder matrix upside-down and holding the grinding particles in contact with the recessed portions of the reversed grinder matrix; and bonding the grinder particles to the grinder matrix using a plating layer formed by electroplating.

Further, there is provided an apparatus for fabricating a grinder used for a grinding machine by bonding super-hard grinding particles to a metallic grinder matrix by electroplating, comprising a plating tank filled with plating solution, a mesh-like holder disposed inside the plating tank and provided with the grinder matrix placed therein, the holder being used to hold therein the grinding particles to be packed onto the periphery of the grinder matrix, anode means disposed inside the plating tank, and an electric circuit for electrically connecting the anode means to the grinder matrix which substantially serves as cathode means.

According to another aspect of the present invention, to achieve the above object, there is provided a method of electrodepositing super-hard grinding particles on a cylindrical and metallic grinder matrix having recessed portions defined in the outer periphery thereof, to thereby produce a grinder, comprising steps of: surrounding grinding surfaces of the grinder matrix with a plating solution permeable member; packing the grinding particles into a space between the permeable member and the grinding surfaces; tightening portions in the outer periphery of the permeable member by tightening means to displace portions of the permeable member toward the corresponding recessed portions of the grinder matrix; and immersing the grinder matrix in a plating tank so as to electrodeposite the grinding particles on the grinding surfaces.

Further, there is provided an apparatus for packing super-heard grinding particles into recessed portions defined in the outer periphery of a cylindrical and metallic grinder matrix disposed on a support table to thereby produce a grinder, comprising a flexible plating solution permeable member which surrounds the recessed portions of the grinder matrix to form a space therebetween into which the grinding particles are packed, and tightening means for displacing portions in the outer periphery of the permeable member toward the corresponding recessed portions of the grinder matrix.

The above and other objects, features and advantages of the present invention will become apparent from the following description and the appended claims, taken in conjunction with the accompanying drawings in which preferred embodiments of the present invention are shown by way of illustrative example.

DETAILED DESCRIPTION OF THE PREFERRED EMBODIMENTS

A method and an apparatus for producing or fabricating a grinder used for a grinding machine, according to the present invention, and a grinding-particle charging apparatus according to the present invention will hereinafter be described in detail with reference to the accompanying drawings in which preferred embodiments are shown by way of illustrative example.

An apparatus according to the present invention, for fabricating a grinder used for a grinding machine will first be described below. Then, a method of producing the grinder will be described below in connection with the grinder producing apparatus.

Figure 1:
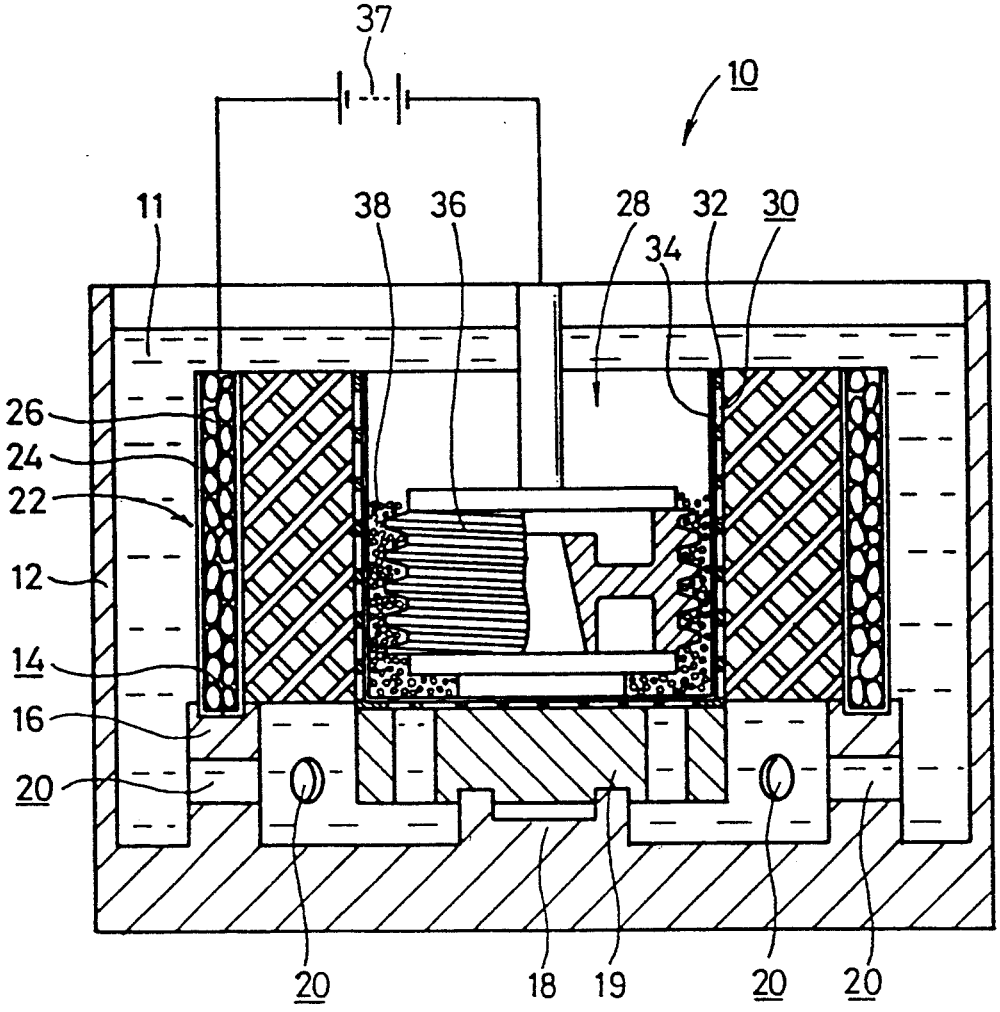
FIG. 1 is a vertical cross-sectional view showing an apparatus for producing a grinder used for a grinding machine, according to one embodiment of the present invention.

As shown in FIG. 1, a grinder producing apparatus 10 has a cylindrical temporary plating tank 12 filled with a plating solution 11. The grinder producing apparatus 10 also has an expansion 16 having a circumferential groove 14 defined therein, which extends upward from the inner bottom face of the plating tank 12. Further, the grinder producing apparatus 10 has an expansion 18 formed inwardly of the circumferentially-formed expansion 16. The expansion 16 has a plurality of holes 20 defined therein. A cylindrical anode case 22 is placed on the expansion 16 so as to be fitted in the groove 14. The anode case 22 is made up of a nylon mesh 24 and has a bag-shaped internal part packed with nickel granules 26. A grinding-particle holder 28 is placed above the expansion 18 with a base 19 interposed therebetween. The grinding-particle holder 28 has a plurality of holes 30 for causing the plating solution 11 to pass therethrough and a cylindrical frame 32 whose upper portion is open. The frame 32 has a nylon mesh 34 applied onto an inner peripheral surface thereof and used to prevent grinding particles 38 to be described later from being discharged to the outside. A grinder matrix 36 having a plurality of tooth-shaped racks defined therein is accommodated in the grinding-particle holder 28 in such a manner that the grinder matrix 36 is sufficiently spaced away from the inner peripheral surface of the frame 32. The grinding particles 38 are packed into a space between the grinder matrix 36 and the frame 32. As the grinding particles 38, there are used those such as cubic-system boron nitride or diamond. Incidentally, the anode case 22 and the grinder matrix 36 are electrically connected to their corresponding anode and cathode of a power supply 37.

Figure 2:
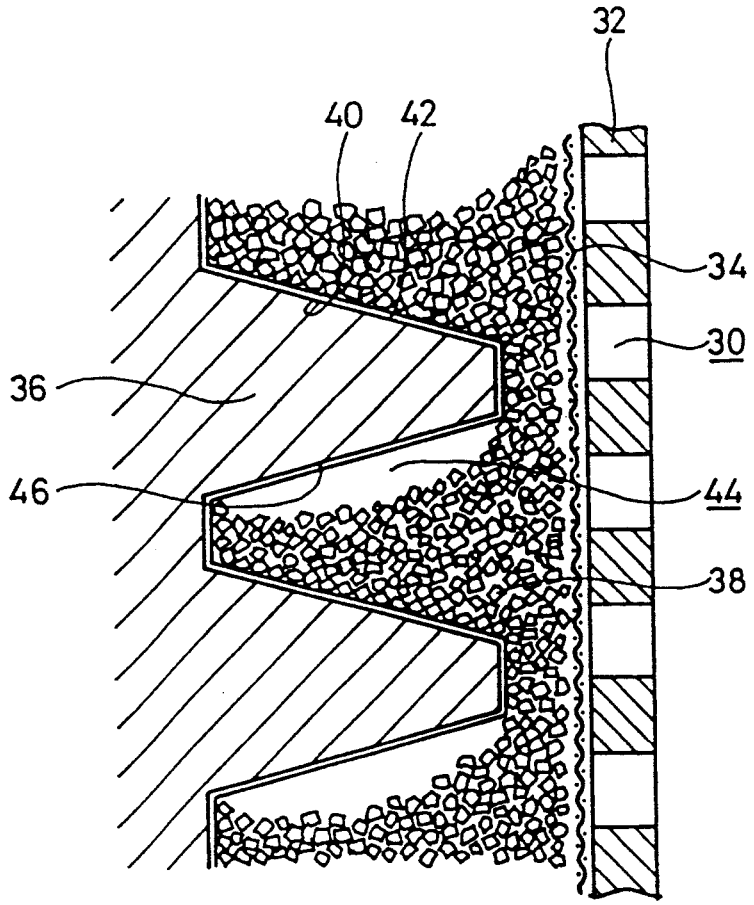
FIG. 2 is a view for describing the manner in which grinding particles are packed by a method of producing a grinder used for a grinding machine, according to one embodiment of the present invention.

The grinder is fabricated in the following manner using the grinder producing apparatus 10 constructed as described above. As shown in FIG. 2, insulators are first attached to surfaces other than tooth-shaped grinding surfaces 40 of the grinder matrix 36 in advance. Further, a surface plating 42 of the order of $2\mu$ to $5\mu$ in thickness is formed on each of the surfaces 40. Then, the grinder matrix 36 is placed inside the grinding-particle holder 28 disposed within the temporary plating tank 12. Thereafter, the inside of the grinding-particle holder 28 is charged with the grinding particles 38. At this time, the grinding particles 38 are smoothly charged into the space between the grinder matrix 36 and the frame 32 because the grinder matrix 36 is sufficiently spaced away from the inner peripheral surface of the frame 32.

Next, the grinder matrix 36 and the anode case 22 are electrically connected to each other by means of an electric circuit. Further, the plating solution 11 stored in the temporary plating tank 12 is stirred by an unillustrated stirring means. As a result, the plating solution 11 is introduced into the anode case 22 and the grinding-particle holder 28 through the nylon mesh 24, the holes 30 and the nylon mesh 34 in that order, thereby leading to contacting with the nickel granules 26 and the grinder matrix 36. By controlling a plating time interval, only the grinding particles 38, which have been brought into contact with the surface plating 42, are fixed or bonded to the grinder matrix 36 by a plating layer (hereinafter called "temporary plating layer") 43 up to the order of 7% to 15% of the diameter of each particle. As a result, the grinding particles 38 are electrodeposited on the corresponding respective surfaces of the grinding-wheel base material 36 in a single layer.

Figure 3:
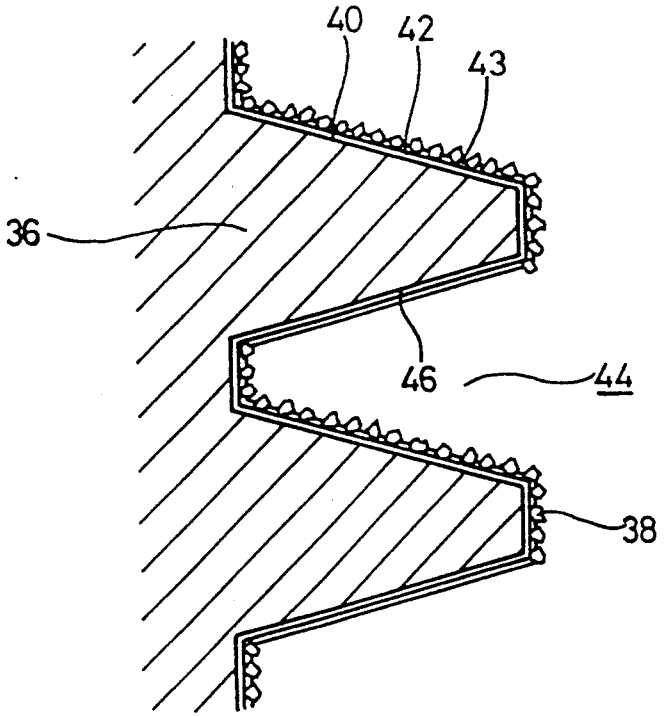
FIG. 3 is a view for describing the manner of electrodeposition of the grinding particles by the method shown in FIG. 2.

Now, the grinding particles 38 are not packed into portions of recesses 44 because they are shaped in the form of polygons having sharp edges. Further, the grinding particles 38 are not held in contact with each slant downward surface 46 because they go down by their own weight during the plating time interval. Thus, when the grinder 36 is washed with water in a state taken out of the temporary plating tank 12 after the plating process has been completed, the grinding particles 38 are electrodeposited on all the surfaces 40 other than the slant downward surfaces 46 in the single layer as illustrated in FIG. 3.

Figure 4:
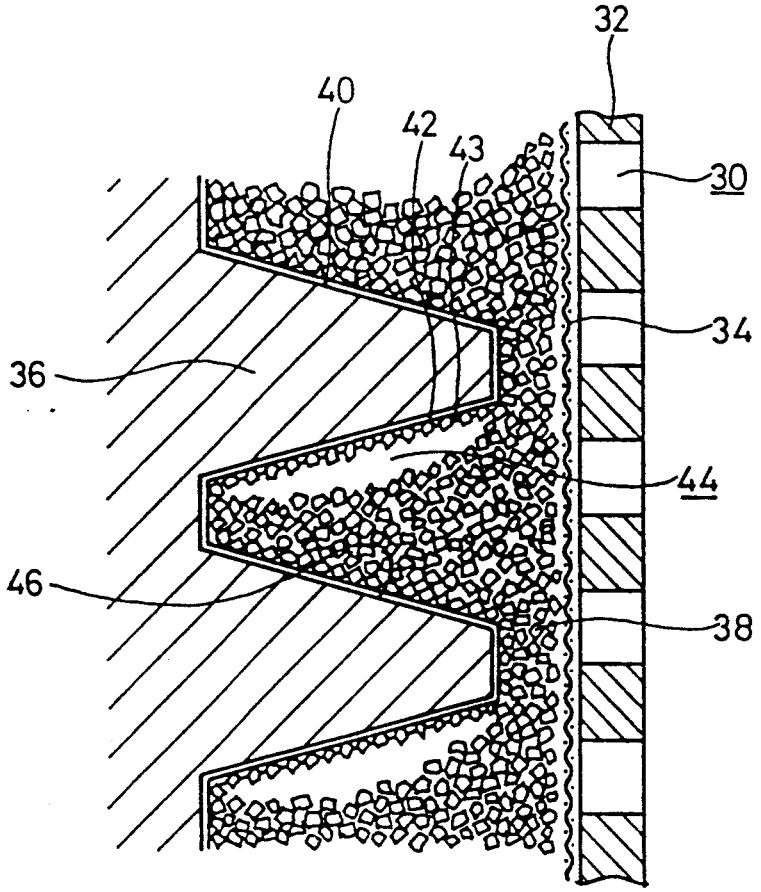
FIG. 4 is a view for describing the manner in which grinding particles are loaded by the method shown in FIG. 2.
Figure 5:
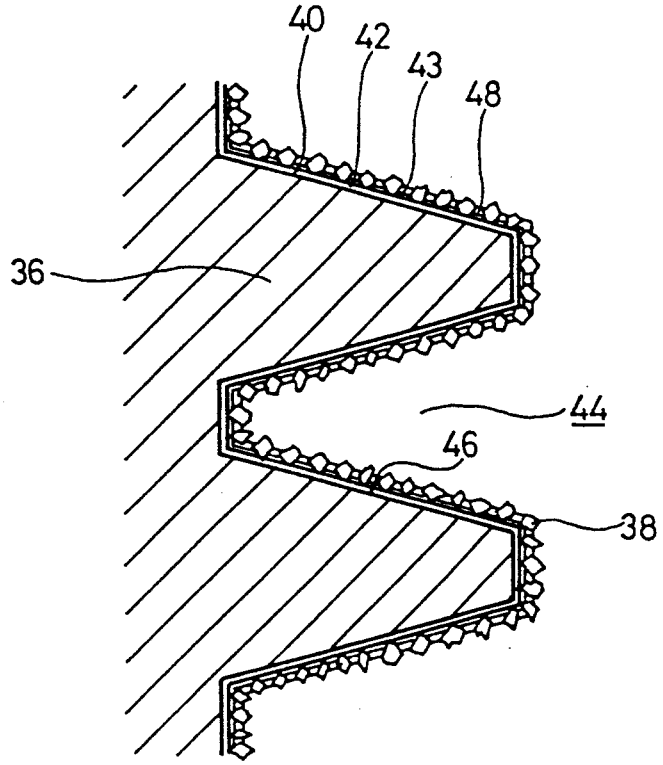
FIG. 5 is a view for describing the manner of another electrodeposition of grinding particles by the method shown in FIG. 2.

Then, the upper and lower sides of the grinder matrix 36 are reversed upside-down and placed again in a grinding-particle holder 28 of another temporary plating tank 12. Further, the grinder matrix 36 is packed with the grinding particles 38 and immersed in the plating solution 11 of the temporary plating tank 12 in a state shown in FIG. 4. Thereafter, the grinding particles 38 are electrodeposited again on the grinder matrix 36 by an electroplating method. In addition, the grinder matrix 36 is taken out of the temporary plating tank 12 and the grinding particles 38 which have been not electrodeposited on the grinder matrix 36, are washed off with water so as to be removed therefrom. As a result, the grinding particles 38 are electrodeposited, in a single layer, even on the corresponding slant upward surfaces 46 (which exist as the slant downward surfaces before the reversing) of the grinder matrix 36, onto which the grinding particles have not been deposited.

After the grinding particles 38 have been electrodeposited on all the surfaces of the grinder matrix 36 in this way, the grinder matrix 36 is immersed in a plating solution of a main plating tank (not shown). Further, the grinding particles 38 are bonded to the grinder matrix 36 by a plating layer (hereinafter called "main plating layer") 48 up to 55% to 70% of the diameter of each particle by the electroplating method or the chemical plating method, thereby making it possible to produce a desired grinder used for a grinding machine.

In the grinder producing method and the grinder producing apparatus according to the present embodiment, the grinding-particle holder 28 is shaped in the form of a cylinder and the inner peripheral surface of the grinding-particle holder 28 is sufficiently spaced away from the outer periphery of the grinder matrix 36. Therefore, when the grinding particles 38 are packed into the space between the outer periphery of the grinder matrix 36 and the inner peripheral surface of the grinding-particle holder 28, the grinding particles can be smoothly packed even into the recessed portions of the grinder matrix. After the grinder matrix 36 have been reversed upside-down and the grinding particles 38 have been electrodeposited twice on the temporary plating layers 43, the grinding particles 38 are electrodeposited on the main plating layers 48 even if the upward and downward surfaces are included in the recessed surfaces of the grinder matrix 36. Therefore, the grinding particles 38 can be reliably electrodeposited on any surface 40 of the grinder matrix 36 in the single layer. Accordingly, a desired grinder formed by electrodepositing the grinding particles on the corresponding surfaces in a uniform single layer, can be produced without effecting troublesome processes such as molding and magnetization of the grinding particles, etc. if the method and the apparatus referred to above are used.

When grinding particles (each having a diameter of 70μ to 40μ), which fall in a range of a mesh #200 to a mesh #325 under the A. S. T. M., are used in the present embodiment, a tooth-surface roughness of $6^S$ or more can be obtained without impairing any grinding capacity even if tooling and dressing are not effected. The experimental result can be shown as follows:

TABLE 1

| A.S.T.M. mesh # | SURFACE ROUGHNESS |
|---|---|
| # 200 to # 230 | $5^S$ to $6^S$ |
| # 230 to # 270 | $4^S$ to $5^S$ |
| # 270 to # 325 | $2^S$ to $4^S$ |

If the grinding particles 38, which belong to the range of the mesh #200 to the mesh #325 under the A. S. T. M., are used, then the surface roughness of $6^S$ or above can be sufficiently ensured, thereby making it possible to obtain toothed wheels which are extremely high in accuracy.

An apparatus according to a second embodiment, for fabricating or producing a grinder used for a grinding machine, and a grinding-particle charging apparatus according to a second embodiment will now be described below. Thereafter, a method of producing the grinder will be described in connection with the grinder producing apparatus. Incidentally, the same elements of structure as those employed in the first embodiment are identified by like reference numerals and their detailed description will therefore be omitted.

Figure 6:
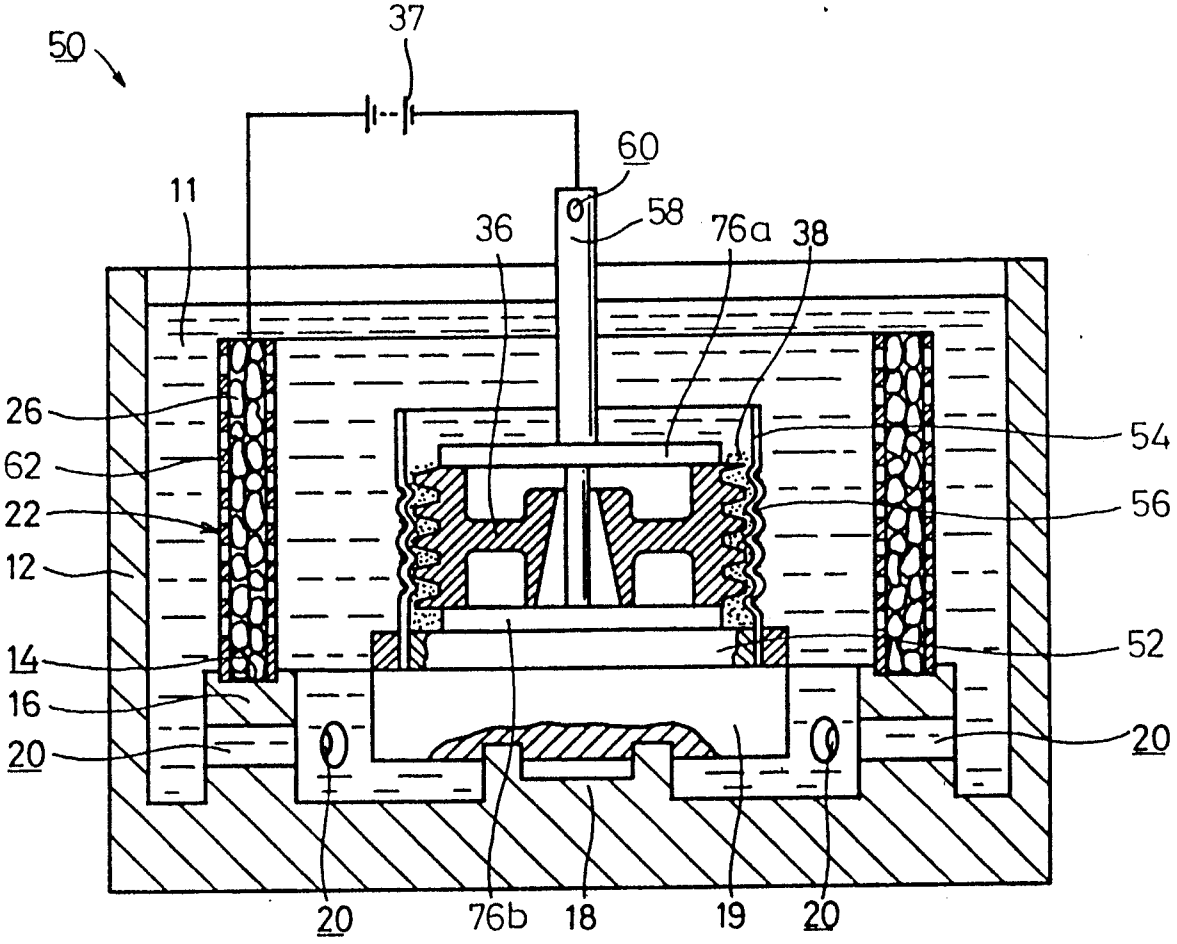
FIG. 6 is a view showing the overall structure of an apparatus for producing a grinder used for a grinding machine, according to another embodiment of the present invention.

As shown in FIG. 6, a grinder producing apparatus 50 is basically constructed in such a manner that a support plate 52 is placed above an expansion 18 with a base 19 interposed therebetween. A nylon mesh 54 is mounted to the support plate 52. In a grinding-particle charging apparatus 70 to be described later, cubic-system boron nitride, diamond or the like are used as the grinding particles 38, which are packed into the space between the nylon mesh 54 tightened by a nylon mesh band 56 and grinding surfaces 40 of a grinder matrix 36. Incidentally, an anode case 22 and the grinder matrix 36 are electrically connected to their corresponding anode and cathode of a power supply 37 in a temporary plating tank 12. A shaft 58 for supporting the grinder matrix 36 has a hole 60 defined in an end thereof. The support plate 52 and the grinder matrix 36 can be loaded into and unloaded from the temporary plating tank 12 by bringing a hook or the like into engagement with the hole 60.

Figure 7:
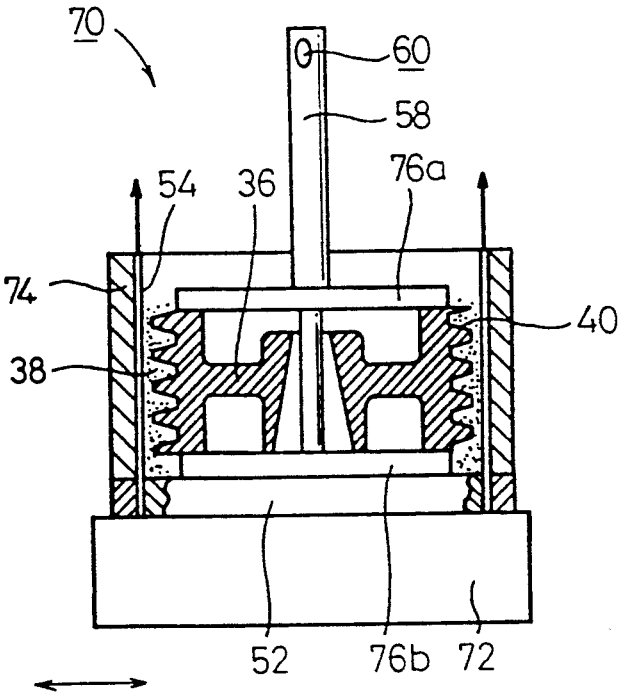
FIG. 7 is a view illustrating the overall structure of a grinding-particle charging apparatus according to one embodiment of the present invention.

The grinding-particle charging apparatus 70 is constructed as shown in FIG. 7. That is, the support plate 52 is mounted on a vibrating table 72. Further, a frame 74 for supporting the nylon mesh 54 is provided on the support plate 52. The nylon mesh 54 thereon is held in contact with the inner peripheral surface of the frame 74 under the action of a tensile force which extends in the direction indicated by the arrow. The grinder matrix 36 is disposed inside the nylon mesh 54.

Figure 8:
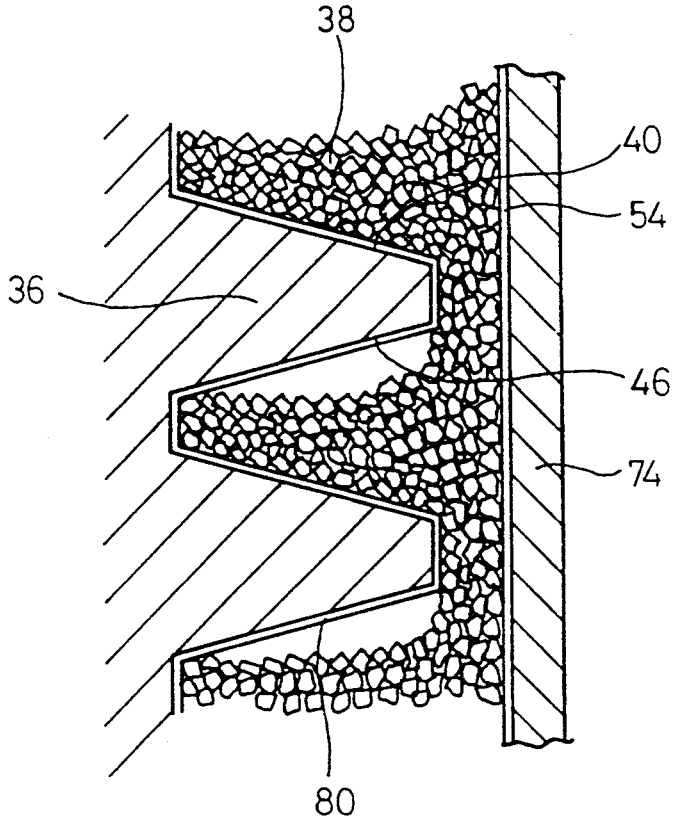
FIG. 8 is a view for describing the manner in which grinding particles are partly packed by the grinding-particles charging apparatus shown in FIG. 7.
Figure 9:
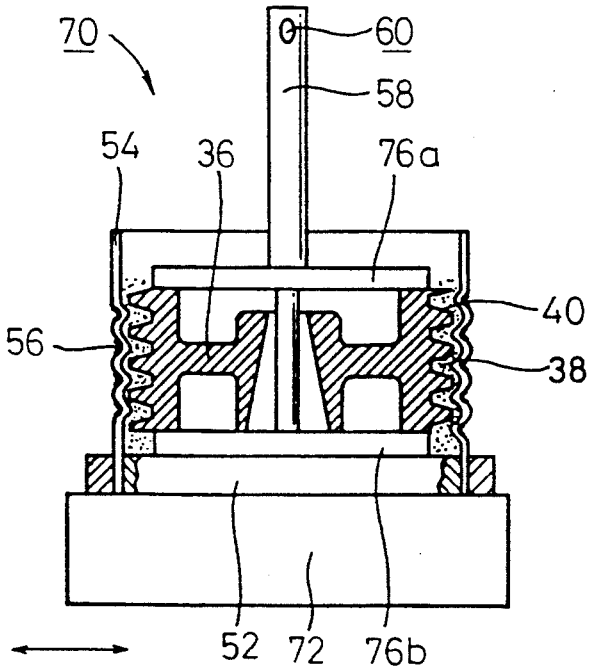
FIG. 9 is a view showing the entire structure of a grinding-particle charging apparatus according to another embodiment of the present invention.
Figure 10:
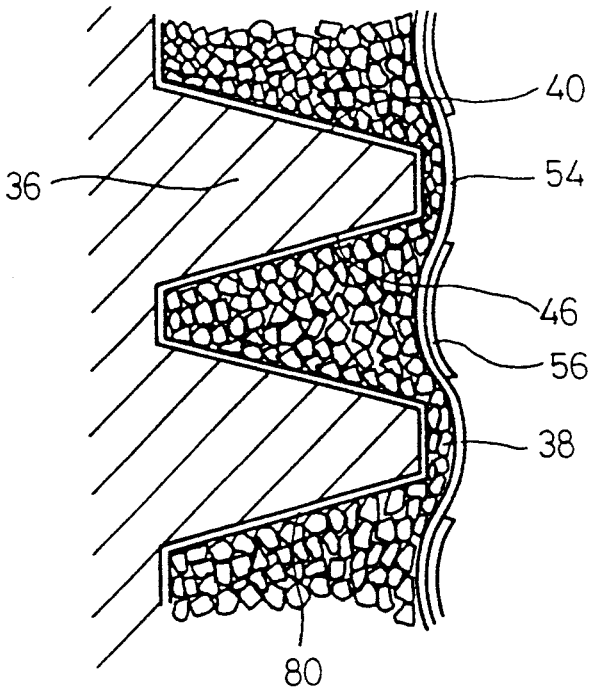
FIG. 10 is a view for describing the manner in which grinding particles are packed by the grinding-particle charging apparatus shown in FIG. 10.

By using the grinder producing apparatus 50 constructed as described above, a grinder is fabricated in the following manner. First of all, insulators **76*a*, 76*b* are mounted on their corresponding surfaces other than the tooth-shaped grinding surfaces 40 of the grinder matrix 36 in advance. Further, a surface plating 80 of the order of 2μ to 5μ in thickness is formed on each of the grinding surfaces 40. Then, the grinder matrix 36 is placed inside the grinding-particle charging apparatus 70, i.e., inwardly of the nylon mesh 54 and the frame 74. Thereafter, the grinding particles 38 are packed into the space between the nylon mesh 54 and the grinding surfaces 40 of the grinder matrix 36. In this case, however, the grinding particles 38 are not loaded in the vicinity of slant downward surfaces 46 of the grinding surfaces 40 as shown in FIG. 8. Hence, the grinding particles 38 are not held in contact with the downward surfaces 46. As shown in FIG. 9, the frame 74 is now detached from the outer peripheral surface of the nylon mesh 54 and the vibrating table 72 is vibrated. Further, the nylon mesh 54 is tightened by the nylon mesh band 56. As a result, the grinding particles 38 are packed onto all the surfaces 40 including the downward surfaces 46 as illustrated in FIG. 10**.

Figure 11:
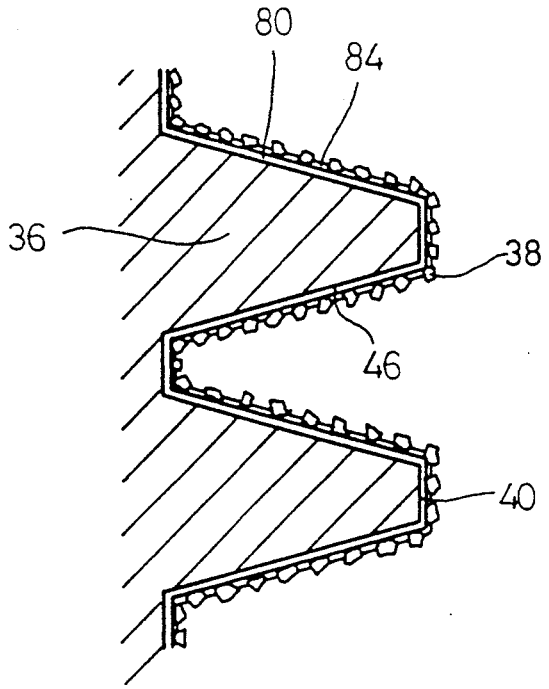
FIG. 11 is a view for describing the manner of electrodeposition of grinding particles onto a grinder matrix by the method shown in FIG. 6.

In this state, the support plate 52 and the grinder matrix 36 are immersed so as to be placed on the base 19 in the temporary plating tank 12. Then, the grinder matrix 36 and the anode case 22 are electrically connected to each other by means of an electric circuit. Further, a plating solution 11 stored in the temporary plating tank 12 is stirred by an unillustrated stirring means. As a result, the plating solution 11 is introduced into the anode case 22 through a nylon mesh 62 made of titan so as to be held in contact with nickel granules 26. Further, the plating solution 11 is introduced into the nylon mesh 54 through the nylon mesh band 56 so as to be brought into contact with the grinder matrix 36. By controlling a plating time interval, only the grinding particles 38, which have been held in contact with the grinding surfaces 40, are bonded to the grinder matrix 36 by a plating layer (hereinafter called "temporary plating layer") 84 up to the order of 7% to 15% of the diameter of each particle. As a result, the grinding particles 38 are electrodeposited on the corresponding surfaces of the grinder matrix 36 in a single layer. Then, the grinder matrix 36 is taken out of the temporary plating tank 12 after the plating process has been completed. Further, the nylon mesh band 56 and the nylon mesh 54 are removed from the grinder matrix 36. Thereafter, the grinder matrix 36 is washed off with water so that the grinding particles 38 which have not been electrodeposited are removed. As a result, the grinding particles 38 are electrodeposited on all the surfaces 40 of the grinder matrix 36 in a single layer as illustrated in FIG. 11.

Further, the grinder matrix 36 is immersed in a plating solution in a main plating tank (not shown). Thereafter, the grinding particles 38 are bonded to the grinder matrix 36 by a plating layer (hereinafter called "main plating layer") up to 55% to 70% of the diameter of each particle by the electroplating method or the chemical plating method, thereby producing a desired grinder.

Thus, in the grinder producing method, the grinder producing apparatus and the grinding-particle charging apparatus according to the present embodiment, the grinding particles 38 are packed into the space between the nylon mesh 54 and the grinding surfaces 40 of the grinder matrix 36 which have been subjected to the surface plating, using the grinding-particle charging apparatus 70. Thereafter, the grinding particles 38 are held in contact with all the grinding surfaces 40 by simply tightening the nylon mesh 54 with the nylon mesh band 56 while the grinding particles 38 are being vibrated by the vibrating table 72. Further, the grinder matrix 36 is immersed in the temporary plating tank 12 so that the grinding particles 38 are temporarily plated. Thereafter, the grinder matrix 36 is washed off with water, thereby removing the grinding particles 38 which have not been electrodeposited thereon. Accordingly, the grinding particles 38 can be uniformly and reliably electro-deposited, in the single layer, on the grinder matrix 36 having the recessed portions.

Incidentally, the frame 74 formed of a porous elastic material such as hard sponge may be constructed so that the nylon mesh 54 is applied onto the inner peripheral surface of the frame 74. With this arrangement, a process for detaching the frame 74 can be eliminated.

Having now fully described the invention, it will be apparent to those skilled in the art that many changes and modifications can be made without departing from the spirit or scope of the invention as set forth herein.

What is claimed is:

1. A method of electrodepositing super-hard grinding particles on a metallic grinder matrix having recessed portions defined in an outer peripheral surface thereof to thereby produce a grinder used for a grinding machine, comprising steps of:

disposing said grinder matrix in a mesh-like holder for holding the grinding-particles provided within a plating tank;

charging the grinding particles into said holder and holding the grinding particles in contact with the recessed portions of the grinder matrix;

bonding the grinding particles to said grinder matrix using a plating layer formed by electroplating;

reversing said grinder matrix upside-down and holding the grinding particles in contact with the recessed portions of the reversed grinder matrix; and bonding the grinding particles to said grinder matrix using a plating layer formed by electroplating.

2. A method of electrodepositing super-hard grinding particles on a cylindrical and metallic grinder matrix having recessed portions defined in the outer periphery thereof, to thereby produce a grinder, comprising steps of:

surrounding grinding surfaces of said grinder matrix with a plating solution permeable member;

packing said grinding particles into a space between said permeable member and said grinding surfaces;

tightening portions in an outer periphery of said permeable member by tightening means to displace said portions of the permeable member toward the corresponding recessed portions of said grinder matrix; and immersing said grinder matrix in a plating tank so as to electrodeposite the grinding particles on said grinding surfaces.

3. A method according to claim 2, wherein a step of applying vibrations to the grinding particles is executed after the completion of the step of packing the grinding particles into said space.

* * * * *